US009997047B2

(12) United States Patent
Nanda et al.

(10) Patent No.: US 9,997,047 B2
(45) Date of Patent: Jun. 12, 2018

(54) SYSTEM AND METHOD FOR DETECTING LUBRICATED BEARING CONDITION

(71) Applicant: General Electric Company, Schenectady, NY (US)

(72) Inventors: Subrat Nanda, Houston, TX (US); Bruno Paes Leao, Rio de Janeiro (BR)

(73) Assignee: General Electric Company, Schenectady, NY (US)

( * ) Notice: Subject to any disclaimer, the term of this patent is extended or adjusted under 35 U.S.C. 154(b) by 0 days. days.

(21) Appl. No.: 15/284,057

(22) Filed: Oct. 3, 2016

(65) Prior Publication Data

US 2018/0096582 A1 Apr. 5, 2018

(51) Int. Cl.

| | |
|---|---|
| ***G08B 21/18*** | (2006.01) |
| ***F01D 21/00*** | (2006.01) |
| ***F01D 25/18*** | (2006.01) |

(52) U.S. Cl.

CPC ..... *G08B 21/182* (2013.01); *F01D 21/003* (2013.01); *F01D 25/18* (2013.01); *F05D 2220/32* (2013.01)

(58) Field of Classification Search

CPC ..... G08B 21/182; F01D 21/003; F01D 25/18; F05D 2220/32

USPC ..... 340/584

See application file for complete search history.

(56) References Cited

U.S. PATENT DOCUMENTS

| | | | | |
|---|---|---|---|---|
| 4,318,179 | A * | 3/1982 | Kure-Jensen | F16C 17/24 374/E1.005 |
| 2010/0107603 | A1* | 5/2010 | Smith | F02C 7/14 60/267 |
| 2010/0178001 | A1* | 7/2010 | Matsunaga | B23Q 1/70 384/448 |
| 2010/0270798 | A1* | 10/2010 | Poulsen | F03D 7/0224 290/44 |

(Continued)

FOREIGN PATENT DOCUMENTS

| | | |
|---|---|---|
| CN | 102230399 B | 7/2014 |
| CN | 102213116 B | 2/2015 |

(Continued)

OTHER PUBLICATIONS

Extended European Search Report issued in connection with corresponding EP Application No. 17192622.3, dated Mar. 23, 2018, 6 pgs.

*Primary Examiner* — Hirdepal Singh
(74) *Attorney, Agent, or Firm* — Fletcher Yoder P.C.

(57) ABSTRACT

A monitoring system includes an analytical engine system coupled to a sensor of an engine system. The analytical engine system is configured to receive data corresponding to operation of the engine system, to determine a distance metric corresponding to the operating parameters of the engine system, to compare the distance metric for a monitored lubricant temperature to a model threshold, and to generate a lubricant alert signal when the distance metric for the monitored lubricant temperature is greater than the model threshold. The received data includes the monitored (Continued)

lubricant temperature of a bearing and operating parameters of the engine system. The distance metric is based at least in part on the monitored lubricant temperature relative to a lubricant temperature statistical model, which is based at least in part on the operating parameters of the engine system.

18 Claims, 3 Drawing Sheets

(56) References Cited

U.S. PATENT DOCUMENTS

2011/0265569 A1* 11/2011 Ganji ..... F16C 19/52 73/587
2012/0148382 A1* 6/2012 Kruger ..... F02C 9/00 415/1
2012/0185180 A1* 7/2012 Frederiksen ..... F03D 17/00 702/35
2014/0007657 A1* 1/2014 Matsubara ..... G01M 13/04 73/53.05
2014/0271284 A1* 9/2014 Gray ..... H02K 5/1732 417/423.1
2015/0068289 A1* 3/2015 Zhong ..... F01M 11/12 73/53.05
2015/0356521 A1* 12/2015 Sridhar ..... G06Q 50/04 705/305
2017/0009621 A1* 1/2017 Ogata ..... F02D 41/0025
2017/0082188 A1* 3/2017 McKimpson ..... F16H 57/01

FOREIGN PATENT DOCUMENTS

JP 63263209 A 10/1988
JP 3348590 B2 11/2002
WO 2016089238 A1 6/2016

* cited by examiner

SYSTEM AND METHOD FOR DETECTING LUBRICATED BEARING CONDITION

BACKGROUND OF THE INVENTION

The subject matter disclosed herein relates to bearings, such as a system and method for detecting the condition of a lubricated bearing of a turbomachinery system.

Turbomachinery may include an apparatus such as a turbine, a compressor, or a pump. One or more components of the turbomachinery rotate about an axis. A bearing of the turbomachinery may facilitate rotation of the one or more components about the axis. Additionally, the bearing may support loads on or generated by the turbomachinery. A load on the bearing that is greater than a design capacity may increase wear on the bearing. Additionally, elements of the bearing may degrade over time, during operation of the turbomachinery, or any combination thereof. Maintenance or replacement of the bearing when the bearing has significant usable life may increase costs and decrease the efficiency of the turbomachinery. Conversely, delayed maintenance or delayed replacement of a worn bearing may increase the possibility of failure of the bearing, or increase the possibility of damage to the turbomachinery.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a monitoring system includes an analytical engine system coupled to a sensor of an engine system. The analytical engine system is configured to receive data corresponding to operation of the engine system, to determine a distance metric corresponding to the operating parameters of the engine system, to compare the distance metric for a monitored lubricant temperature to a model threshold, and to generate a lubricant alert signal when the distance metric for the monitored lubricant temperature is greater than the model threshold. The received data includes the monitored lubricant temperature of a bearing and operating parameters of the engine system. The distance metric is based at least in part on the monitored lubricant temperature relative to a lubricant temperature statistical model, which is based at least in part on the operating parameters of the engine system.

In a second embodiment, non-transitory computer readable medium includes instructions configured to be executed by a processor of a control system. The instructions include instructions configured to cause the processor to receive a first set of data corresponding to operation of a first turbomachinery system, to determine a distance metric corresponding to the operating parameters of the engine system, to compare the distance metric for a monitored lubricant temperature to a model threshold, and to generate a lubricant alert signal when the distance metric for the monitored lubricant temperature is greater than the model threshold. The first set of received data includes the monitored lubricant temperature of a first bearing and operating parameters of the first turbomachinery system. The distance metric is based at least in part on the monitored lubricant temperature relative to a lubricant temperature statistical model, which is based at least in part on the operating parameters of the first turbomachinery system.

In a third embodiment, a method of operating an analytical engine system includes receiving data corresponding to operation of a gas turbine system, determining a distance metric corresponding to operating parameters of the gas turbine system, comparing the distance metric for a monitored lubricant temperature to a model threshold, and generating a lubricant alert signal when the distance metric for the monitored lubricant temperature is greater than the model threshold. The received data includes the monitored lubricant temperature of a bearing and the operating parameters of the gas turbine system. The distance metric is based at least in part on the monitored lubricant temperature relative to a lubricant temperature statistical model, which is based at least in part on the operating parameters of the gas turbine system.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Lubricated bearings may support rotating components of turbomachinery and engine systems, such as a gas turbine system. Time and use may affect the lubricant and the lubricated elements of the bearing. Through monitoring parameters associated with the lubricated bearing or turbomachinery, it is believed that the condition of the bearing may be determined. Changes in the loading on the bearing may affect the friction within the bearing, and increased friction within the bearing may increase the temperature of the lubricant. Monitoring the temperature of the lubricant in addition to other parameters associated with the lubricated bearing or turbomachinery may enable the construction of a robust model of the bearing condition, as discussed in detail below.

Figure 1:
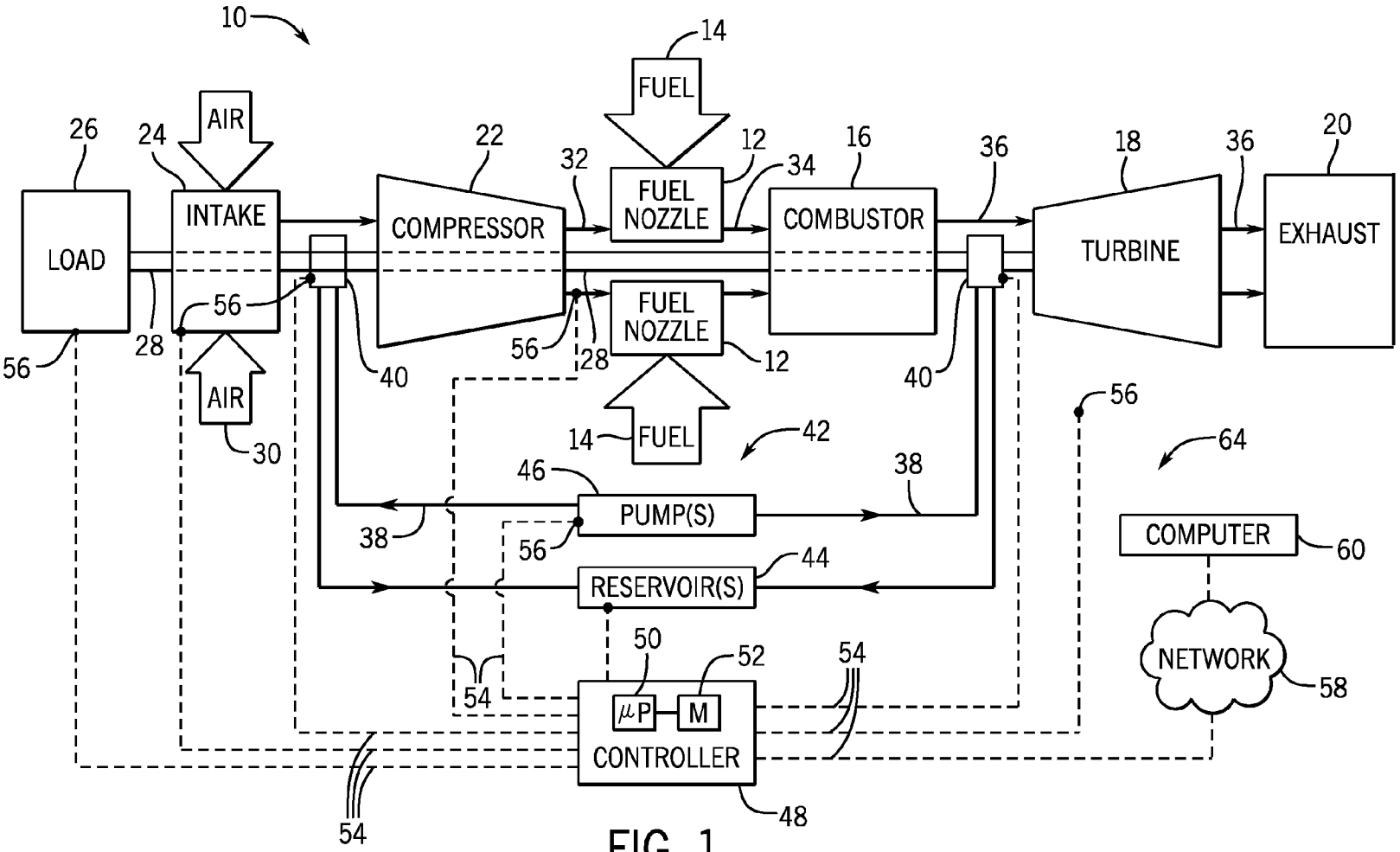
FIG. 1 is an embodiment of a gas turbine turbomachinery system with an analytical engine system.

Turning now to the drawings and referring first to FIG. 1, a block diagram of an embodiment of an engine system 10 (e.g., gas turbine system) is illustrated. The diagram includes fuel nozzles 12, fuel 14, and a combustor 16. As depicted, the fuel 14 (e.g., a liquid fuel and/or gas fuel, such as natural gas) is routed to the turbine system 10 through the fuel nozzle 12 into the combustor 16. The combustor 16 ignites and combusts the air-fuel mixture 34, and then passes hot pressurized exhaust gas 36 into a turbine 18. The exhaust gas 36 passes through turbine blades of a turbine rotor in the turbine 18, thereby driving the turbine 18 to rotate. The coupling between blades in the turbine 18 and a shaft 28 will cause the rotation of the shaft 28, which is also coupled to several components (e.g., compressor 22, load 26) throughout the turbine system 10. It may be appreciated that while only one shaft 28 is discussed below, the gas turbine system 10 may have multiple shafts 28 (e.g., coaxial shafts) driven by rotation of the blades of the turbine 18. Eventually, the exhaust gases 36 of the combustion process may exit the turbine system 10 via an exhaust outlet 20.

In an embodiment of the turbine system 10, compressor vanes or blades are included as components of the compressor 22. Blades within the compressor 22 may be coupled to the shaft 28, and will rotate as the shaft 28 is driven to rotate by the turbine 18. The compressor 22 may intake air 30 to the turbine system 10 via an air intake 24. Further, the shaft 28 may be coupled to the load 26, which may be powered via rotation of the shaft 28. As appreciated, the load 26 may be any suitable device that may generate power via the rotational output of the turbine system 10, such as a power generation plant or an external mechanical load. For example, the load 26 may include an electrical generator, a propeller of an airplane, and so forth. The air intake 24 draws air 30 into the turbine system 10 via a suitable mechanism, such as a cold air intake, for subsequent mixture of the air 30 with the fuel 14 via the fuel nozzles 12. Air 30 taken in by the turbine system 10 may be fed and compressed into pressurized air 32 by rotating blades within the compressor 22. The pressurized air 32 may then be fed into the one or more fuel nozzles 12. The fuel nozzles 12 may then mix the pressurized air 32 and fuel 14, to produce a suitable air-fuel mixture 34 for combustion, e.g., a combustion that causes the fuel 14 to more completely burn, so as not to waste fuel 14 or cause excess emissions in the exhaust gases 36. Again, the turbine 18 is driven by the exhaust gases 36.

One or more bearings 40 of the gas turbine system 10 support the shaft 28. The one or more bearings 40 may provide radial support for the shaft 28, axial support for the shaft 28, or any combination thereof. In some embodiments, one or more of the bearings 40 is a lubricated bearing. A bearing system 42 may supply a lubricant 38 (e.g., oil, grease, gas) from a reservoir 44 to the bearing 40 via one or more pumps 46. The reservoir 44 may include, but is not limited to one or more tanks, one or more sumps, or any combination thereof. In some embodiments, a controller 48 may control the one or more pumps 46 of the bearing system 42. In some embodiments, the controller 48 of the bearing system 42 controls or monitors components of the gas turbine system 10. That is, the controller 48 may be a dedicated controller of the bearing system 42, or a multipurpose controller of the gas turbine system 10. Additionally, or in the alternative, the controller 48 may be removably coupled to the bearing system 42. For example, the controller 48 may be coupled to the bearing system 42, as shown in FIG. 1, during an inspection or maintenance period when the controller 48 may download logged data from the bearing system 42.

The controller 48 may include one or more processors 50 and a memory 52. The one or more processors 50 may be operatively coupled to the memory 52 to execute instructions for carrying out the presently disclosed techniques. These instructions may be encoded in programs or code stored in a tangible non-transitory computer-readable medium, such as the memory 52 and/or other storage. The processor 50 may be a general purpose processor (e.g., processor of a desktop/laptop computer), system-on-chip (SoC) device, or application-specific integrated circuit, or some other processor configuration. The memory 52, in the embodiment, includes a computer readable medium, such as, without limitation, a hard disk drive, a solid state drive, diskette, flash drive, a compact disc, a digital video disc, random access memory (RAM), and/or any suitable storage device that enables the processor 50 to store, retrieve, and/or execute instructions and/or data. The memory 52 may include one or more local and/or remote storage devices.

The controller 48 is coupled to components of the gas turbine system 10 via a plurality of data lines 54, shown as dashed lines in FIG. 1. Each data line 54 may transmit data signals between the controller 48 and components of the gas turbine system 10. For example, one or more sensors 56 throughout the gas turbine system 10 may communicate sensor data with the controller 48 via one or more respective data lines 54. The sensors 56 may provide feedback to the controller 48 regarding various properties (e.g., operating parameters) of the gas turbine system 10 including, but not limited to, temperature (e.g., lubricant temperature, gas temperature, ambient temperature, exhaust temperature, component operating temperature), pressure (e.g., ambient pressure, fuel pressure, compressor discharge pressure, exhaust pressure, lubricant pressure), composition (e.g., lubricant composition, air intake composition, fuel mixture composition, exhaust gas composition), load on the turbine 18, fluid levels (e.g., fuel 14, lubricant reservoir 44), or any combination thereof. That is, the controller 48 may store (via the memory 52) data corresponding to operation of the gas turbine system 10 for concurrent or later retrieval (e.g., download). Additionally, or in the alternative, the controller 48 may communicate control signals to components (e.g., pump 46, intake 24, compressor 22, fuel nozzle 12) via the one or more respective data lines 54 of the gas turbine system 10.

The controller 48 may be coupled to a network 58 via a wired or wireless connection. In some embodiments, the controller 48 receives instructions or other data to store in the memory 52 from the network 58. Additionally, the controller 48 may transmit data (e.g., control history, sensor feedback) to the network 58. The controller 48 may communicate with the network 58 continuously, at regular or scheduled intervals when the controller 48 is coupled to the network 58, on-demand at the command of an operator of the gas turbine system 10 or the network 58, or any combination thereof. The network 58 may store the data from the controller 48 for later access (e.g., backup, review). In some embodiments, the network 58 may utilize the data from the controller 48 to construct or modify a model of the performance of the gas turbine system 10. Additionally, or in the alternative, the network may utilize the data from the controller 48 with data from controllers 48 of other gas turbine systems 10 to construct or modify such a model. A computer 60 coupled to the network 58 may facilitate communication between the controllers 48 of multiple gas turbine systems 10. Moreover, a computer 60 may transmit data (e.g., instructions, models, thresholds, system updates) to the controllers 48 of multiple gas turbine systems 10, and the computer 60 may receive data from the controllers 48 via the network 58. In some embodiments, the remote computer 60 generates or modifies a model, and distributes the model to a plurality of controllers 48 via the network 58.

As described herein, sensor feedback from the gas turbine system 10 (or other turbomachinery) may be utilized to monitor the condition of the one or more bearings 40. The controller 48, the network 58, one or more computers 60 coupled to the network 58, or any combination thereof, may utilize sensor feedback to monitor the condition of the one or more bearings 40. As discussed herein, a term analytical engine system 64 is understood to refer to the controller 48, the network 58, one or more computers 60, or any combination thereof. It is believed that the temperature of the lubricant 38 and the load (e.g., axial and/or radial) on the bearing 40 during operation may be used to identify the occurrence of a condition (e.g., anomalies, wear) on the bearing 40, thereby enabling the maintenance or replacement of the bearing 40 at a cost-effective time that may reduce downtime of the gas turbine system 10 while preserving the operational integrity of the gas turbine system 10. Operating history and feedback from other sensors 56 may also be used to determine the condition of the bearing 40. The controller 48 may monitor the sensor feedback from the gas turbine system 10 through comparison of the sensor feedback to one or more models stored in memory 52 or on the network 58. Likewise, the network 58, one or more computers 60 coupled to the network 58, or any combination thereof, may monitor the sensor feedback from the gas turbine system 10 through comparison of the sensor feedback to one or more models stored in memory 52 or on the network 58.

Figure 2:
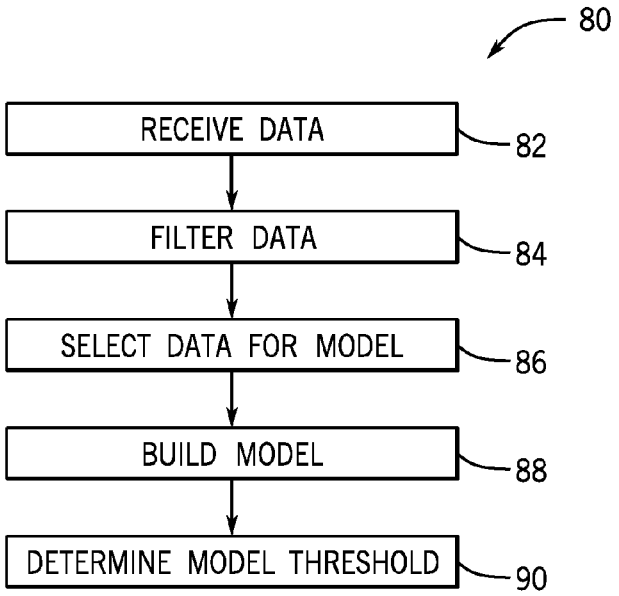
FIG. 2 is an embodiment of a method for constructing or modifying a model used to monitor the condition a bearing of the turbomachinery system.

FIG. 2 illustrates a method 80 of the construction (e.g., building, generation) and subsequent modification of a model used to monitor the condition of the one or more bearings 40. To construct or modify the model, the analytical engine system 64 receives (block 82) data. In some embodiments, the method 80 may be executed by a computer (e.g., controller 48) directly coupled to one or more gas turbine systems 10, or to a computer (e.g., network 58, computer 60 coupled to the controller 48 via the network 58) that is remote from and uncoupled to a gas turbine system 10. That is, the computer may receive (block 82) the data for construction or modification of the model directly from a turbomachinery system, or from a data input (e.g., network, memory device, manual input).

The received data may include, but is not limited to, sensor feedback, system identification information, operational history, maintenance history, inspection data, or any combination thereof. For example, the sensor feedback may include one or more of the following: a temperature of the lubricant 38 in the bearing 40, a temperature of the lubricant 38 in the pump 46, a temperature of the lubricant 38 in the reservoir 44, a level of the lubricant 38 in the reservoir 44, a discharge pressure of the compressor 22 (e.g., high pressure compressor), a pressure of the exhaust gas 36, a temperature of the exhaust gas 36, a shaft speed, an ambient environment temperature, an ambient environment pressure, and a humidity of the ambient environment. The system identification information may include, but is not limited to, a model number, a serial number, an installation site for the turbomachinery (e.g., gas turbine system 10), and so forth. The operational history may include, but is not limited to, duration of operation, duration at base loading, duration at peak loading, duration at idle, and startup/shutdown cycles. The maintenance history may include, but is not limited to, date(s) of last service, scheduled maintenance completed, and maintenance technician identity. The inspection data may include, but is not limited to, the condition of the one or more bearings as determined from a previous inspection or maintenance service. It may be appreciated that the analytical engine system 64 (e.g., controller 48, network 58, computer 60) may receive (block 82) data for the model from one or more turbomachines, such as a fleet of gas turbine systems 10 distributed The analytical engine system 64 (e.g., controller 48, network 58, computer 60) filters (block 84) the received data based on what is determined to be invalid data for modeling. In some embodiments, the analytical engine system 64 may filter out, or remove from further consideration, received data that does not correspond to a steady state operation of the turbomachine based at least in part on the lubricant temperature. For example, the lubricant temperature may be much lower at a start up of the turbomachinery than during a steady state operation. Additionally, or in the alternative, the lubricant temperature may change based at least in part on a load on the turbomachinery or a rotational speed of the turbomachinery. Accordingly, the analytical engine system 64 may filter (block 84) the received data so that the data used for the construction or modification of the model does not include received data that corresponds to an operation interval where the lubricant temperature is changing. That is, data from steady state operation may better facilitate modeling and comparison than data from dynamic operating periods. In some embodiments, the received data may be removed (e.g., filtered) from further consideration when the lubricant temperature changes more than 1, 2, 3, 4, 5, 10, or more degrees Celsius over an operation interval. In some embodiments, the operation interval is approximately 5, 10, 15, 30, 60, or more minutes.

The analytical engine system 64 (e.g., controller 48, network 58, computer 60) selects (block 86) a subset of the filtered data for the construction or modification of the model. The subset of the filtered data may be selected because it represents normal operation of the turbomachinery within design conditions. Criteria for selection of the subset from the filtered data may include, but is not limited to whether a load is engaged with the turbomachinery, a quantity (e.g., measured quantity, calculated quantity) of the load on the turbomachinery, a compressor discharge pressure, or any combination thereof. For example, the criteria for selection of the subset from the filtered data may be data when the turbomachinery is loaded with a minimum load and the compressor discharge pressure is greater than approximately 3447 kPa (500 psi). Additionally, or in the alternative, the compressor discharge pressure may be used alone to select the subset of the filtered data. It is believed that the compressor discharge pressure of the gas turbine system 10 is related to the loading on the one or more bearings 40.

The analytical engine system 64 (e.g., controller 48, network 58, computer 60) generates (block 88) a probability distribution model using the selected subset of the filtered data. The generated probability distribution model may represent a multivariate Gaussian metric, such as a Hotelling's $T^2$ statistic or a Runger $U^2$ statistic. The selected subset of the filtered data used to generate the model may be stored or processed in a matrix (e.g., selected matrix) formed from a plurality of vectors. Each vector of the plurality of vectors may include sensor feedback and/or estimated load data corresponding to a known time or duration. For example, each vector may include one or more lubricant temperatures, one or more gas (e.g., oxygen, exhaust) temperatures, fluid (e.g., fuel, lubricant) pressures, a load on the shaft, a rotational speed, or any combination thereof. The analytical engine system 64 processes the selected matrix to generate (block 88) the probability distribution model with a calculated mean vector and a calculated covariance matrix. It may be appreciated that the probability distribution model may be modified by adding vectors to or removing vectors from the selected matrix, then recalculating the mean vector and covariance matrix of the selected matrix. As discussed in detail below, the mean vector and covariance matrix of the probability distribution model may be used to evaluate sample data vectors to a distance metric to a normal condition of the bearing. It may be appreciated that a small distance corresponds to a relatively high degree of confidence of a normal condition (e.g., lubricant temperature), and a large distance metric corresponds to a relatively low degree of confidence of the normal condition, or an abnormal condition.

The analytical engine system 64 (e.g., controller 48, network 58, computer 60) determines (block 90) model thresholds to differentiate between variations that correspond to normal operation of the turbomachinery and variations that correspond to abnormal operation of the turbomachinery. For example, the analytical engine system 64 may determine a model threshold distance through application of the model to test data sets corresponding to empirically determined abnormal operating conditions, such as conditions immediately preceding a bearing failure or other event Additionally, the analytical engine system 64 may determine a model threshold distance through application of the model to the filtered data from block 84, where the model threshold distance may be based on a determined balance between acceptable false alarm rate (e.g., less than 10, 9, 8, 7, 6, 5, 4, 3, 2, or 1 percent) and minimum coverage (e.g., greater than 80, 85, 90, or 95 percent detection). That is, the analytical engine system 64 may determine a model threshold distance that provides a 7 percent or less false alarm rate and correctly determines an anomaly with a 91 percent detection rate. In some embodiments, the analytical engine system 64 may determine a model threshold distance through application of the model to the filtered data based on only the acceptable false alarm rate. In some embodiments, the model threshold may be based at least in part on a non-parametric histogram of the received data, the filtered data, or the selected data. In some embodiments, the model threshold may vary based at least in part on a load on the turbomachinery, a rotational speed of the turbomachinery, a duration of operation (e.g., continuous operation) of the turbomachinery, or any combination thereof. That is, the model threshold for a low load steady state operating condition may be different than (e.g., greater than) the model threshold for a high-load steady state operating condition.

Figure 3:
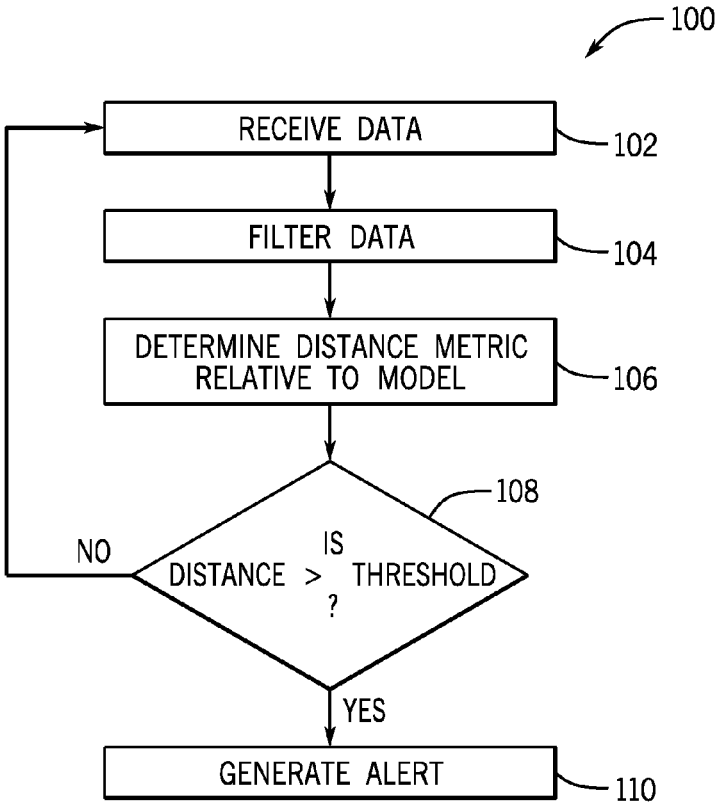
FIG. 3 is an embodiment of a method for utilizing the model to monitor the status of a lubricated bearings of the turbomachinery system.

After construction of the model, as described above and shown by method 80 in FIG. 2, the analytical engine system 64 (e.g., controller 48, network 58, computer 60) executes method 100 to monitor the operation of a turbomachinery system. For example, the analytical engine system 64 may utilize method 100, as shown in FIG. 3, to monitor the condition of one or more lubricated bearings 40 of a turbomachinery system, such as a gas turbine system 10. The analytical engine system 64 (e.g., controller 48, network 58, computer 60) receives (block 102) data from the turbomachinery system. Similar to block 82 described above with method 80, the received data may include, but is not limited to, sensor feedback, system identification information, operational history, maintenance history, inspection data, or any combination thereof. For example, the sensor feedback may include one or more of the following: a temperature of the lubricant 38 in the bearing 40, a temperature of the lubricant 38 in the pump 46, a temperature of the lubricant 38 in the reservoir 44, a level of the lubricant 38 in the reservoir 44, a discharge pressure of the compressor 22 (e.g., high pressure compressor), a pressure of the exhaust gas, a temperature of the exhaust gas, a shaft speed, an ambient environment temperature, an ambient environment pressure, and a humidity of the ambient environment. The analytical engine system 64 may receive the data from the turbomachinery system continuously or at regular intervals. For example, the analytical engine system 64 may receive a data sample approximately every 1, 5, 10, 20, 60, 120, or 240 minutes. Moreover, the received data sample may correspond to one sample time (e.g., one sample vector), or to a set of sample times (e.g., plurality of sample vectors).

The analytical engine system 64 (e.g., controller 48, network 58, computer 60) filters (block 104) the received data based on what is determined to be invalid for comparison with the model. For example, the analytical engine system 64 may filter out, or remove from further consideration, received data that does not correspond to a steady state operation of the turbomachine based at least in part on one or more measurements of the lubricant temperature. The analytical engine system 64 then determines (block 106) a distance metric relative to the model for the remaining received data (e.g., filtered data). As described above, the model may include, but is not limited to, a Hotelling's $T^2$ statistic or a Runger $U^2$ statistic. The Hotelling's $T^2$ metric may be determined using the following Equation 1:

$$T^2=(X_{new}-\overline{X})^T S_x^{-1}(X_{new}-\overline{X}) \qquad \text{Equation 1}$$

where $X_{new}$ is a vector of the filtered data, $\overline{X}$ is the mean vector of the multivariate Gaussian model, $S_x$ is the covariance matrix, and $T^2$ is the distance metric. As discussed above, smaller determined values for the distance metric $T^2$ indicate a greater confidence that the data corresponding to the distance metric $T^2$ represents a normal operating behavior.

The Runger metric may be determined using the following Equation 2:

$$U^2=T^2-(Z_{new}-\overline{Z})^T S_z^{-1}(Z_{new}-\overline{Z}) \qquad \text{Equation 2}$$

where $Z_{new}$ is a vector of the filtered data corresponding to a subset of $X_{new}$ values, $\overline{Z}$ is the mean vector of the associated multivariate Gaussian model corresponding to a subset of $\overline{X}$, $S_z$ is the covariance matrix, $T^2$ is Hotelling's $T^2$ metric, and $U^2$ is the distance metric of the Runger $U^2$ statistic. It may be appreciated that the whereas the distance metric $T^2$ of the Hotelling's $T^2$ metric is obtained directly from the multivariate Gaussian probability distribution, the distance metric $U^2$ is conditioned on the values of predefined variables that represent operational and ambient conditions before determining the distance metric $U^2$. The analytical engine system 64 (e.g., controller 48, network 58, computer 60) may generate (block 88) the model data set with the selected data through a statistical process.

Upon determination of the distance metric (e.g., $U^2$, $T^2$), the analytical engine system 64 (e.g., controller 48, network 58, computer 60) compares (node 108) to the appropriate threshold. It may be appreciated that the appropriate threshold may be based on the load on the turbomachinery, a rotational speed of the turbomachinery, a duration of operation (e.g., continuous operation) of the turbomachinery, or any combination thereof. If the distance metric is less than the appropriate threshold, then the analytical engine system 64 returns to block 102 to receive the next set of data without generating an alert signal. If the distance metric is greater than the appropriate threshold, then the analytical engine system 64 (e.g., controller 48, network 58, computer 60) generates (block 110) an alert signal. The alert signal may be an audible signal, a visual signal, a haptic signal, an electronic signal transmitted to an electronic device (e.g., display, controller, network device), or any combination thereof. In some embodiments, the analytical engine system 64 generates (block 110) the alert signal for an operator to observe. Additionally, or in the alternative, the analytical engine system 64 generates (block 110) the alert signal to be stored in a memory with the filtered data for a later review. For example, the controller 48 may generate an alert signal, which is later observed or communicated with the network 58 and/or a computer 60 when the data from the controller 48 memory 52 is reviewed by the network 58 or computer 60. Furthermore, in some embodiments, the analytical engine system 64 generates (block 110) the alert or generates an elevated alert when a predetermined quantity of distance metrics exceed the appropriate threshold during a predetermined time period. For example, the analytical engine system 64 may generate the alert when three determined distance metrics exceed the appropriate threshold during a four hour period. The predetermined quantity of distance metrics and the predetermined time period may be empirically determined or adjusted to reduce or eliminate false-indications of alerts. In some embodiments, an alert may expire after an elapsed time period in the conditions for the alert are not observed again during the elapsed time.

The method 100 described above may be used to monitor one or more parameters of the gas turbine system 10. For example, the method 100 may be used to monitor the condition of one or more of the bearings 40 through monitoring the lubricant temperature. The monitored lubricant temperature may include at least one of a bearing lubricant temperature in the lubricated bearing 40, a supply lubricant temperature in the pump 46, and a return lubricant temperature in the reservoir 44 (e.g., sump). Therefore, the models and thresholds described above may be used to generate an alert in response to an abnormality of one or more monitored lubricant temperatures.

The load (e.g., thrust) on the bearing 40 may be calculated or measured and compared to a model or an expected value to generate an alert in response to an abnormality of the load. In some embodiments, the load on the bearing 40 may be calculated based at least in part on one or more pressures in the turbine 18 (e.g., forward cavity, bleed path cavity) of the gas turbine system 10, a load on the blades of the compressor 22 and the blades of the turbine 18, and a strain on a flexible coupling of the gas turbine system 10. It may be appreciated that the forward cavity may be a chamber within the turbine near one of the bearings 40 proximate the turbine, and the bleed path cavity may be a chamber within the turbine near one of the bearings 40 that receives a compressor bleed flow. The load on the bearing 40 may be compared to generate a model via the method 100 described above or another method.

The monitored lubricant temperature may be used together with the monitored load on the bearing 40 to determine the operational condition of the bearing 40. It is believed that monitoring of the load on the bearing 40 independent from, and in addition to monitoring the lubricant temperature, may improve diagnostics of the operational condition of the bearing 40 relative to monitoring only the load on the bearing 40 or only the lubricant temperature. For example, an anomalous load alert may be due to an anomalous condition of the bearing 40, instrumentation issues, or an improper setup/calibration, and an anomalous lubricant temperature alert may be due to an anomalous condition of the bearing, a lubricant temperature sensor issue, or an insufficient model. Analysis of the load alert and the lubricant temperature alert together as described herein may enable improved diagnostics of the bearing 40 and gas turbine system 10.

The analytical engine system 64 (e.g., controller 48, computer 60) may monitor the condition of the bearing 40 and the gas turbine system 10 through assigning alarm codes to various combinations of the load alert and the lubricant temperature alert. The analytical engine system 64 may associate one of the following alarm codes with the operational condition of the gas turbine system 10 during a monitoring period. In some embodiments, the analytical engine system 64 may continuously determine whether the load alert or the bearing alert have been generated. Additionally, or in the alternative, the analytical engine system 64 may periodically determine whether the load alert or the bearing alert have been generated. For example, the analytical engine system 64 may periodically monitor the load alert and the bearing alert at intervals of approximately 5, 10, 15, 30, 45, 60, 120, 240 or more minutes. Furthermore, in some embodiments, an alert or an alarm code may latch, such that an alarm code for a condition other than normal may only be assigned once per latch interval (e.g., 8, 12, 24 hours or more). Table 1 below lists an embodiment of the alarm codes (e.g., 0, 1, 2, 3) that the analytical engine system 64 (e.g., controller 48, network 58, computer 60) may utilize:

TABLE 1

| Load Alert | Lubricant Temperature Alert | Alarm Code | Possible Reason for Alert | Proposed Prescription |
|---|---|---|---|---|
| No | No | 0 | No issue (normal condition). | No prescription. |
| No | Yes | 1 | Temperature sensor calibration; bearing issue without load alert; insufficient model | No immediate action, yet investigate if frequent occurrence |
| Yes | No | 2 | Issue with sensor input for load calculation; improper parameters for load calculation | Investigate non-bearing issue at or before next maintenance period |
| Yes | Yes | 3 | Issue with variable orifice position; thrust balance issue | Investigate immediately; shut down gas turbine system. |

As illustrated above, alarm code 0 corresponds to a normal condition of the gas turbine system 10. That is, neither the calculated load nor the lubricant temperature alerts have been generated. The analytical engine system 64 assigns the alarm code 1 in response to only a lubricant temperature alert without a load alert. Operation of the gas turbine system 10 may continue with the alarm code 1, as the lubricant temperature alert may have been generated for benign reasons that do not necessarily indicate a bearing issue. In particular, the alarm code 1 may correspond to an improperly positioned or calibrated temperature sensor or a normal operating condition for which the presently utilized model is insufficient. An operator may generally continue operation of the gas turbine system 10 with the alarm code 1; however, further investigation into the root cause of the lubricant temperature may be desired if operation with the alarm code 1 is a frequent occurrence (e.g., a majority of monitoring intervals, daily). The recurrence of alarm code 1 may provide sufficient cause for the operator to investigate and resolve the issue to reduce the occurrence of the alarm code 1. Moreover, such an investigation resulting from alarm code 1 may identify a bearing anomaly that may not otherwise be detected from the calculated load.

The analytical engine system 64 assigns the alarm code 2 in response to only a load alert without a lubricant temperature alert. Thus, the alarm code 2 may indicate that the bearing 40 is operating normally with normal conditions, yet an issue with the parameters or inputs for the calculated load may be generating the load alert. Accordingly, an operator may seek to investigate the non-bearing issue at or before next maintenance period to resolve the calculated load issue to reduce the occurrence of the alarm code 2.

The analytical engine system 64 assigns the alarm code 3 in response to both a load alert and a lubricant temperature alert. Thus, the alarm code 3 may indicate that abnormal operating condition of the bearing 40. As may be appreciated, an increased load on the bearing 40 may increase the friction on the bearing 40, thereby increasing the lubricant temperature. Accordingly, the alarm code 3 indicates that both the load and the lubricant temperature exceed predetermined thresholds to generate respective alerts. The alarm code 3 may be caused by an improper orifice setting to supply the lubricant to the bearing 40, wear on the bearing 40, or a leak in a flow through the gas turbine system 10. For at least the reason that the load alert and the lubricant temperature alert are based at least in part on design parameters of the bearing 40 and the gas turbine system 10, the operator may initiate or schedule a shutdown of the gas turbine system 10 in response to the alarm code 3. In some embodiments, the analytical engine system 64 (e.g., controller 48) may initiate the shutdown automatically in response to the alarm code 3; however, the analytical engine system 64 may initiate the shutdown after a notification delay (e.g., 1, 5, 10, 30, or 60 minutes).

It may be appreciated that the information presented above in Table 1 is presented as an example that is not necessarily an exhaustive list of potential alarm codes, possible reasons for alerts, or proposed prescriptions. The analytical engine system 64 (e.g., controller 48, network 58, computer 60) or an operator may utilize additional monitored data and/or operational history in addition to an alarm code to determine a possible reason and proposed prescription for a given alarm code.

Figure 4:
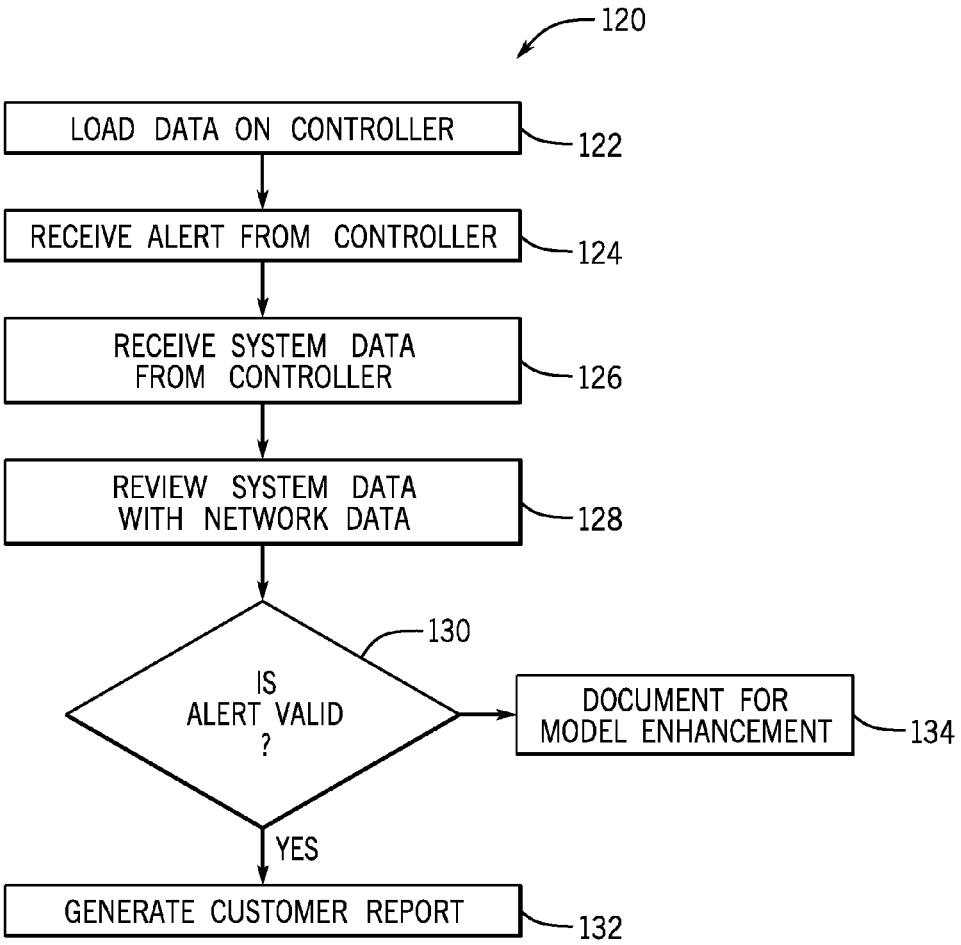
FIG. 4 is an embodiment of a method of managing alerts and operating a remote computer coupled to the turbomachinery system.

In some embodiments, the computer of the analytical engine system 64 assigning the alarm codes is remote from the gas turbine system 10. For example, a manufacturer may communicate with a plurality of controllers of a fleet of gas turbines via a network 48. FIG. 4 illustrates an embodiment of a method 120 of operating the remote computer and managing alerts. The computer 60 of the analytical engine system 64 may load (block 122) data on the controller 48 of the gas turbine system 10. The loaded data may include, but is not limited to, a model to determine a distance metric for a monitored parameter (e.g., lubricant temperature) or a threshold for the monitored parameter. During operation of the gas turbine system 10, the computer 60 of the analytical engine system 64 may receive (block 124) an alert from the controller 48 of the gas turbine system 10. The received alert may be a load alert, a lubricant temperature alert, an alarm code, or any combination thereof. Additionally, the computer 60 of the analytical engine system 64 may receive (block 126) data from the controller 48 of the analytical engine system 64. The received data may correspond to the data compared with the model and threshold that generated the alert. The received data may include, but is not limited to, sensor feedback, system identification information, operational history, maintenance history, inspection data, or any combination thereof.

Upon receipt of the data, the computer 60 reviews (block 128) the received data from the controller 48. The computer 60 may review the received data by reevaluating the received data with the same or a different model as used by the controller 48 of the gas turbine system 10 that generated the alert. Because the computer 60 is coupled via the network 58 of the analytical engine system 64 to a plurality of controllers 48 of a respective plurality of gas turbine systems 10, the computer 60 of the analytical engine system 64 may utilize the received data from multiple gas turbine systems 10 to update (e.g., modify) the one or more models used to generate the alerts. Additionally, or in the alternative, the computer 60 of the analytical engine system 64 may utilize the received data from multiple gas turbine systems 10 to update (e.g., modify) the one or more models used to generate the thresholds. Accordingly, the computer 60 may use an updated model and/or an updated threshold to review (block 128) the received data that generated the alert.

The computer 60 of the analytical engine system 64 validates (node 130) the alert received based at least in part on the result of the review of the received data. That is, where the review by the computer 60 of the received data confirms the alert, the computer 60 generates (block 132) a customer report. As discussed herein, generating the report may include transmitting the customer report to the customer or a responsible agent for the customer. The customer report may include, but is not limited to, an alarm code, a prescribed action by the customer to reduce future costs, a scheduled maintenance period, or any combination thereof. Additionally, or in the alternative, the customer report may be an audible signal, a visual signal, or any combination thereof. Where the review by the computer 60 of the received data does not confirm the alert, the computer 60 documents (block 134) the received data for model and/or threshold enhancement. That is, the computer 60 of the analytical engine system 64 may continually modify the model and/or threshold to better account for new data sets. Modifying the model with the received data may increase the robustness of the respective model for future applications of the model. Moreover, the computer 60 of the analytical engine system 64 may identify trends among the received data from one or more controllers 48 that resulted in an invalidated alert, such that the model may be improved to properly account for the identified trends. In a similar manner, thresholds may be reviewed and modified based at least in part on identified trends from the received data of an invalidated alert.

Technical effects of the invention include the determination of a bearing operating condition using more than a calculated load on the bearing, which may be subject to instrumentation errors. Moreover, the validation of an alert related to the bearing based at least in part on independent measurements (e.g., calculated load, lubricant temperature) may increase the confidence of an alert. Increasing the confidence of an alert and reducing the quantity of false indications may reduce maintenance costs and downtime of a gas turbine system. Furthermore, the capability to modify and update models and thresholds utilized for the lubricant temperature alert enable the capabilities and confidence of the monitoring system to improve over time. Models and thresholds may be implemented on a per system basis or across multiple systems.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A monitoring system, comprising:

an analytical engine system coupled to a sensor of an engine system, wherein the analytical engine system is configured to:

receive data corresponding to operation of the engine system over a time period, wherein the received data comprises a plurality of monitored lubricant temperatures of a bearing and operating parameters of the engine system;

determine a plurality of distance metrics corresponding to the operating parameters of the engine system over the time period, wherein the plurality of distance metrics is based at least in part on the plurality of monitored lubricant temperatures relative to a lubricant temperature statistical model, wherein the lubricant temperature statistical model is based at least in part on the operating parameters of the engine system;

compare the plurality of distance metrics for the plurality of monitored lubricant temperatures to a model threshold;

generate a lubricant alert signal when multiple distance metrics of the plurality of distance metrics for the plurality of monitored lubricant temperatures are greater than the model threshold over the time period; and shut down the engine system when a lubricant alert signal is generated and a load alert signal is generated, wherein the load alert signal is independent of the lubricant alert signal, and the load alert signal is based at least in part on a calculated load on the bearing.

2. The monitoring system of claim 1, wherein the lubricant temperature statistical model comprises a Hotelling's $T^2$ statistic or a Runger $U^2$ statistic.

3. The monitoring system of claim 1, wherein the analytical engine system comprises a memory configured to store the lubricant temperature statistical model and the received data corresponding to operation of the engine system.

4. The monitoring system of claim 1, wherein the analytical engine system is configured to filter the received data based at least in part on whether the received data corresponds to a steady state operation of the engine system over the time period, wherein steady state operation of the engine system is based at least in part on the operating parameters of the engine system over the time period.

5. The monitoring system of claim 1, wherein the sensor comprises a temperature sensor, and the plurality of monitored temperatures is based at least in part on sensor feedback from the temperature sensor.

6. The monitoring system of claim 1, wherein the plurality of monitored temperatures comprises supply lubricant temperatures, return lubricant temperatures, or any combination thereof.

7. The monitoring system of claim 1, wherein the analytical engine system is configured to determine a calculated load on the bearing based at least in part on pressure feedback from one or more locations of the engine system, wherein the operating parameters comprise the pressure feedback.

8. The monitoring system of claim 7, wherein the analytical engine system is configured to:

compare the calculated load to a load threshold; and generate a load alert signal when the calculated load is greater than the load threshold, wherein the load alert signal is independent from the lubricant alert signal.

9. The monitoring system of claim 1, wherein the analytical engine system is configured to transmit the lubricant alert signal to a network, the network is coupled to a plurality of gas turbine systems, and the plurality of gas turbine systems comprises the engine system.

10. The monitoring system of claim 1, wherein the analytical engine system is configured to:

receive secondary data corresponding to operation of a second turbomachinery system over a second time period, wherein the secondary data comprises a second plurality of monitored lubricant temperatures of a second bearing and second operating parameters of the second turbomachinery system;

filter the received data and the received secondary data to generate filtered data that corresponds to a steady state operation of the first turbomachinery system over the time period and the second turbomachinery system over the second time period;

select a subset of the filtered data that corresponds to a normal operation of the first turbomachinery system and the second turbomachinery system, wherein the subset is selected from the filtered data of the received data based at least in part on a first load on the first turbomachinery system over the time period, a first compressor discharge pressure of the first turbomachinery system over the time period, or any combination thereof, and the subset is selected from the filtered data of the received secondary data based at least in part on a second load on the second turbomachinery system over the second time period, a second compressor discharge pressure of the second turbomachinery system over the second time period, or any combination thereof; and modify the lubricant temperature model based at least in part on the subset of the filtered data.

11. A non-transitory computer readable medium comprising instructions configured to be executed by a processor of a control system, wherein the instructions comprise instructions configured to cause the processor to:

receive a first set of data corresponding to operation of a first turbomachinery system, wherein the first set of received data comprises a monitored lubricant temperature of a first bearing and operating parameters of the first turbomachinery system;

determine a distance metric corresponding to the operating parameters of the engine system, wherein the distance metric is based at least in part on the monitored lubricant temperature relative to a lubricant temperature statistical model, wherein the lubricant temperature statistical model is based at least in part on the operating parameters of the first turbomachinery system;

compare the distance metric for the monitored lubricant temperature to a model threshold;

generate a lubricant alert signal when the distance metric for the monitored lubricant temperature is greater than the model threshold; and receive a second set of data corresponding to operation of a second turbomachinery system, wherein the second set of received data comprises a second monitored lubricant temperature of a second bearing and second operating parameters of the second turbomachinery system;

filter the first set of received data and the second set of received data to generate filtered data that corresponds to a steady state operation of the first turbomachinery system and the second turbomachinery system;

select a subset of the filtered data that corresponds to a normal operation of the first turbomachinery system and the second turbomachinery system, wherein the subset is selected from the filtered data of the first set of received data based at least in part on a first load on the first turbomachinery system, a first compressor discharge pressure of the first turbomachinery system, or any combination thereof, and the subset is selected from the filtered data of the second set of received data based at least in part on a second load on the second turbomachinery system, a second compressor discharge pressure of the second turbomachinery system, or any combination thereof; and modify the lubricant temperature statistical model based at least in part on the subset of the filtered data.

12. The non-transitory computer readable medium of claim 11, wherein the instructions comprise instructions configured to cause the processor to:

determine a calculated load on the first bearing based at least in part on pressure feedback from one or more locations of the first turbomachinery system, wherein the operating parameters comprise the pressure feedback;

compare the calculated load to a load threshold; and generate a load alert signal when the calculated load is greater than the load threshold, wherein the load alert signal is independent from the lubricant alert signal.

13. The non-transitory computer readable medium of claim 12, wherein the instructions comprise instructions configured to cause the processor to:

assign an alarm code to the first set of received data based at least in part on whether the processor has generated the lubricant alert signal, and on whether the processor has generated the load alert signal.

14. The non-transitory computer readable medium of claim 13, wherein the instructions comprise instructions configured to cause the processor to shut down the first turbomachinery system when the alarm code corresponds to a generated lubricant alert signal and a generated load alert signal.

15. The non-transitory computer readable medium of claim 11, wherein the instructions comprise instructions configured to cause the processor to:

filter the first set of received data to generate filtered data that corresponds to a steady state operation of the first turbomachinery system;

select a subset of the filtered data that corresponds to a normal operation of the first turbomachinery system, wherein the subset is selected based at least in part on a load on the first turbomachinery system, a compressor discharge pressure, or any combination thereof; and modify the lubricant temperature statistical model based at least in part on the subset of the filtered data.

16. The non-transitory computer readable medium of claim 11, wherein the monitored temperature comprises a plurality of lubricant temperatures, and the plurality of lubricant temperatures comprises a bearing lubricant temperature, a supply lubricant temperature, a return lubricant temperature, or any combination thereof.

17. A method of operating an analytical engine system, comprising:

receiving data corresponding to operation of a gas turbine system, wherein the received data comprises a monitored lubricant temperature of a bearing and operating parameters of the gas turbine system;

determining a distance metric corresponding to the operating parameters of the gas turbine system, wherein the distance metric is based at least in part on the monitored lubricant temperature relative to a lubricant temperature statistical model, wherein the lubricant temperature statistical model is based at least in part on the operating parameters of the gas turbine system;

comparing the distance metric for the monitored lubricant temperature to a model threshold;

generating a lubricant alert signal when the distance metric for the monitored lubricant temperature is greater than the model threshold;

determining a calculated load on the bearing based at least in part on pressure feedback from one or more locations of the gas turbine system, wherein the operating parameters comprise the pressure feedback;

comparing the calculated load to a load threshold;

generating a load alert signal when the calculated load is greater than the load threshold, wherein the load alert signal is independent from the lubricant alert signal; and assigning an alarm code to the first set of received data based at least in part on whether the lubricant alert signal has been generated and whether the load alert signal has been generated.

18. The method of claim 17, comprising communicating the lubricant alert signal, via a network, to an operator of the gas turbine system, a servicer of the gas turbine system, or a manufacturer of the gas turbine system, or any combination thereof.

* * * * *